US006579585B1

(12) United States Patent
Garvic et al.

(10) Patent No.: US 6,579,585 B1
(45) Date of Patent: Jun. 17, 2003

(54) PARTIALLY-SECURED LABEL, LABEL SHEET AND MANUFACTURING METHOD

(75) Inventors: James E. Garvic, Olathe, KS (US); Mike H. Wilkinson, Shawnee, KS (US)

(73) Assignee: Graphic Technology, Inc., New Century, KS (US)

( * ) Notice: Subject to any disclaimer, the term of this patent is extended or adjusted under 35 U.S.C. 154(b) by 0 days.

(21) Appl. No.: 09/410,395

(22) Filed: Oct. 1, 1999

(51) Int. Cl.[7] ..... B42D 15/00

(52) U.S. Cl. ..... 428/40.1; 283/81; 283/101; 283/105; 283/107; 428/41.9; 428/42.1; 428/42.2; 428/42.3; 428/43; 428/192; 428/194

(58) Field of Search ..... 428/40.1, 42.1, 428/42.2, 42.3, 43, 41.9, 192, 194; 283/81, 101, 105, 107

(56) References Cited

U.S. PATENT DOCUMENTS 4,758,456 A * 7/1988 Muscala ..... 428/42.1
5,702,127 A * 12/1997 Korondi ..... 283/81
5,704,648 A * 1/1998 Brown ..... 283/81

* cited by examiner

*Primary Examiner*—Nasser Ahmad
(74) *Attorney, Agent, or Firm*—Hedman & Costigan, P.C.

(57) ABSTRACT

Label sheets are formed from a continuous web of laminated stock material comprising a face stock layer and a liner layer secured together by an adhesive layer. The stock material is delaminated and an adhesive deactivating material is applied to the adhesive layer in longitudinal strips to create active and inactive adhesive portions. Label sheets are formed by cutting the web of stock material transversely. Individual labels are formed on the label sheets by kiss-cutting the face stock layer. Each individual label includes an attachment end with active adhesive and a free/unattached end with inactive adhesive. A method of manufacturing partially-secured labels includes the steps of delaminating a stock material, deactivating strips of an adhesive layer, and relaminating the stock material. The method also includes the steps of cutting the stock material into individual label sheets and kiss-cutting the label sheets to form individual, partially-secured labels.

9 Claims, 6 Drawing Sheets

PARTIALLY-SECURED LABEL, LABEL SHEET AND MANUFACTURING METHOD

BACKGROUND OF THE INVENTION

1. Field of the Invention

The present invention relates generally to adhesive labels, and in particular to a partially-secured label and a method of manufacturing same utilizing an adhesive deadening agent.

2. Description of the Prior Art

Labels are well known and various types have been proposed to meet the requirements of a wide variety of label applications. For example, labels are extensively used in retail businesses for communicating product information to customers. Examples of labels used in retail merchandising include product labeling, preprinted packaging, and point-of-purchase display labels.

Point-of-purchase displays typically place merchandise within easy reach of consumers. Exemplary applications include self-service grocery, department, discount, and specialty stores and shops. Many of the merchandise items in such establishments lend themselves to shelf displays. For example, product containers such as boxes, bottles, jars, cans, and the like are typically well-suited for shelf displays. Such self-service retail marketing arrangements are popular with merchants because customers typically make their own selections. Labor costs can thus be minimized. However, personnel are needed for labeling the shelves adjacent to the merchandise stocked and displayed thereon.

Shelf-mounted labels commonly identify products and include such information as quantities and pricing. Certain types of retail businesses, such as grocery stores and discount merchandisers, experience frequent price changes. Consequently the point-of-purchase displays are frequently relabeled in many such establishments.

A common type of shelf label has an outer surface with the aforementioned information printed thereon and an inner surface with adhesive and non-adhesive portions. The adhesive portion of the inner surface is designed for adhering the label to the front, or outer, edge of a shelf. Such labels are commonly manufactured in sheets, each of which includes a number of labels. The label face stock layer is precut into a plurality of discrete labels. The backs of the label sheets are typically perforated or otherwise precut to separate the adhesive portions from the non-adhesive portions. For example, the entire back of the face stock layer can be coated with adhesive, which can mount a liner. In forming the prior art labels, portions of the liner are removed to expose the label adhesive portions. Removing a portion of the back liner from each such prior art label thus provides both adhesive and non-adhesive portions of the label inner surface.

Although such prior art shelf labels are in widespread use and can be manufactured with existing equipment, they are subject to several disadvantages. For example, such prior art labeling operations tend to be relatively labor intensive. More specifically, the label sheets must be separated into discrete labels and the liner portions which are designed for removal must be removed. The store personnel can then mount the labels by pressing the adhesive portions of the inner surfaces against the shelf edges whereby messages printed on the label outer surfaces are visible. Such messages can be preprinted when the labels are manufactured in "service bureau" operations. Alternatively, blank label sheets can be provided for printing and marking by the customers. The labels can be partly printed during manufacture. Additional message information, such as pricing, can be applied to the labels at the point-of-purchase.

Heretofore, there has not been available a partially-secured label, label sheet and method of manufacturing same with the advantages and features of the present invention.

SUMMARY OF THE INVENTION

A label sheet includes a vinyl face stock layer and a liner. The face stock layer has a layer of adhesive applied thereto. The adhesive includes alternating strips of active and inactive adhesive portions. The inactive adhesive portions are rendered inactive by applying an adhesive deadening material thereto. Labels are formed in the vinyl face stock layer by kiss-cutting same. Each label includes an attached end with a portion of an active adhesive strip. Each label also includes a free, unattached end with a portion of an inactive adhesive strip. A labeling method includes the steps of delaminating a laminated material, applying strips of an adhesive deadening material, relaminating the vinyl face stock and the liner. The vinyl face stock is kiss-cut to form a plurality of discreet labels. Each label includes an attached end with active adhesive thereon and a free, unattached end with inactive adhesive thereon.

OBJECTS AND ADVANTAGES OF THE INVENTION

The principal objects and advantages of the present invention include: providing a partially-secured label; providing sheets of such labels; providing such labels which utilize a deadening agent for forming adhesive and non-adhesive portions; providing such a label which minimizes the labor involved in removing same from a sheet and placing same on a shelf display; providing such a label which is efficient in operation, economical to manufacture and particularly well adapted for the proposed use thereof; providing a label sheet which is adapted for both service bureau preprinting during manufacture and customer printing; providing a method of manufacturing partially-secured labels; providing such a method which is efficient in material and labor costs; and providing such a label which is resistant to distortion from freezer curl and other causes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
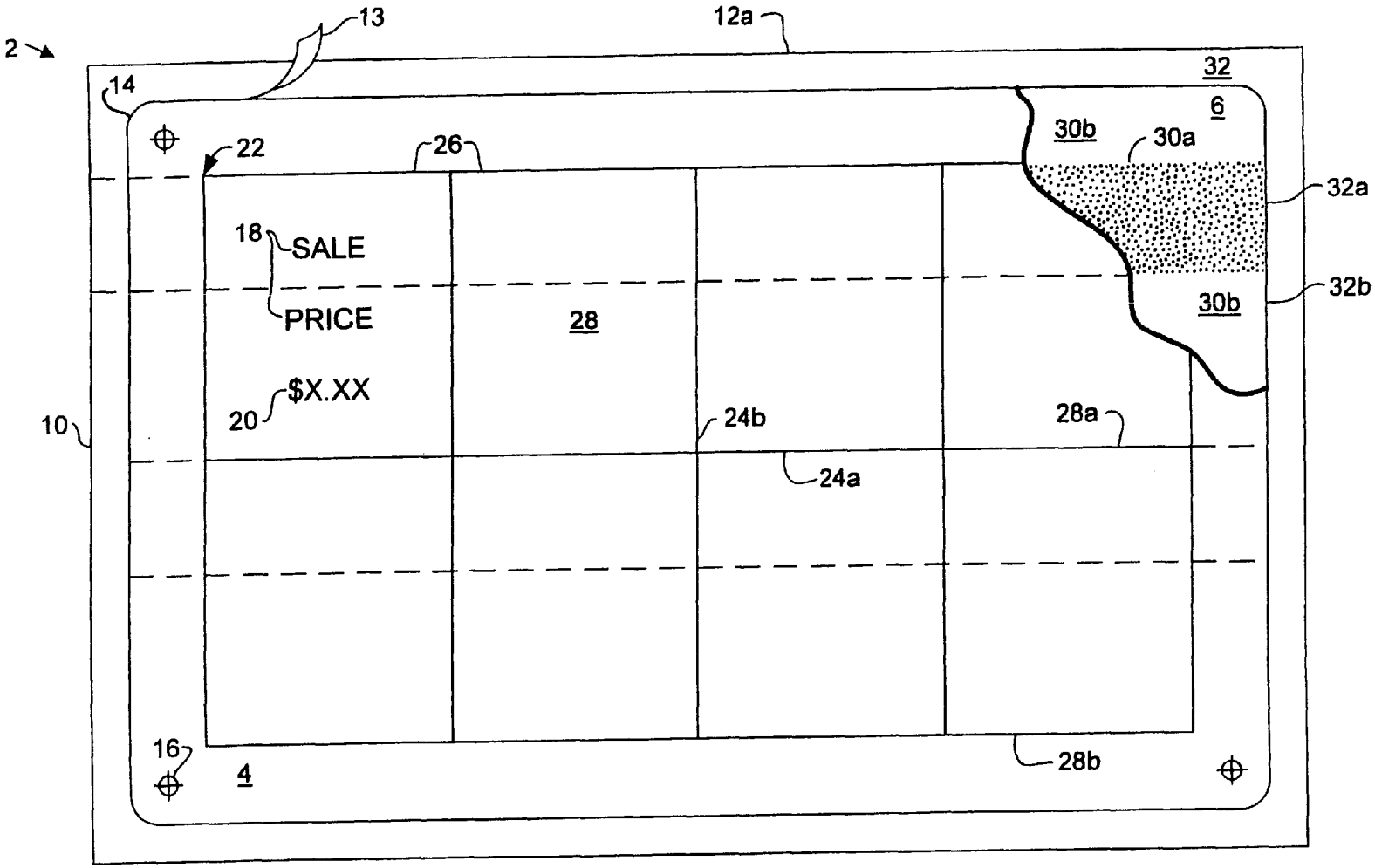
FIG. 1 is a plan view of a sheet of partially-secured labels embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a label sheet embodying the present invention. The label sheet 2 generally comprises a face stock layer 4 and a liner 6. The face stock layer 4 and the liner 6 are adhesively bonded in a continuous stock material 3 from which the label sheets 2 are formed according to the manufacturing method of the present invention. The stock material 3 is commercially available in continuous rolls with various widths.

II. Face Stock Layer 4

The face stock layer 4 includes inner and outer face stock surfaces 8*a,b*; opposite end margins 10; and top/side and bottom/side margins 12*a,b*. Selvage 13 surrounds the face stock layer margins 10, 12 and is adapted for removal from the finished label sheet 2. The face stock layer 4 includes rounded comers 14 and printing alignment marks 16 located adjacent to the comers 14.

The label sheets 2 are adapted for preprinting during manufacture, printing on site by the customer (e.g., in a laser printer), or both. The illustrated embodiment includes preprinting 18 and customized, on-site printing 20, both applied to the face stock layer 4 outer surface 8*b*.

A cut pattern 22 consists of multiple cut line segments 24 which form perimeters 26 of individual, discrete labels 28. As shown, the cut pattern 22 consists of longitudinal cut line segments 24*a* and transverse cut line segments 24*b* which collectively form a grid pattern of the cut pattern 22. The cut pattern 22 preferably extends through the face stock layer 4 between the inner and outer surfaces 8*a,b* thereof. An adhesive layer 30 is applied to the face stock layer inner surface 8*a* and can comprise any suitable pressure-sensitive, self-adhesive material, such as acrylic adhesive, which is releasable for repositioning purposes and which leaves little or no residue. Acrylic adhesive has a further advantage of not being susceptible to melting during printing operations, e.g. in laser printers. The adhesive layer 30 includes an active portion 30*a* which will adhere a label 28 to any suitable surface and an inactive portion 30*b* whereat the adhesive has been neutralized with a suitable deadening agent.

Figure 5:
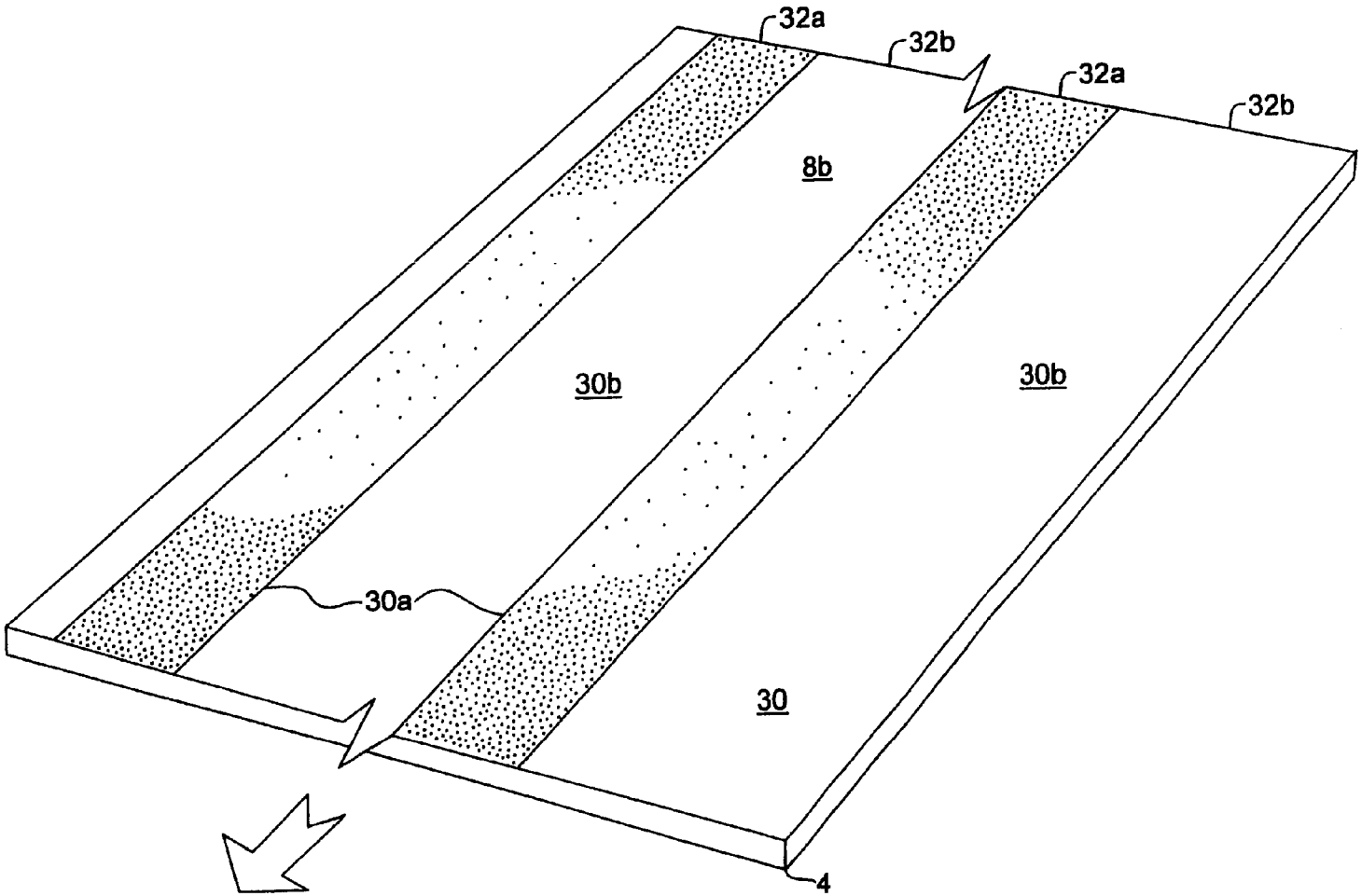
FIG. 5 is a perspective view of a face material vinyl stock layer with adhesive deadening agent strips applied thereto.

As shown in FIGS. 1 and 5, the inactive adhesive layer portions 30*b* comprise longitudinal strips which generally align along one edge with a respective longitudinal segment 24*a*. Each label 28 includes an attachment end 28*a* with an active adhesive portion 30*a* thereat and a free or unattached end 28*b* with an inactive adhesive portion 30*b* thereat. The face stock layer 4 can comprise any suitable material, such as vinyl. The material is preferably chosen for its printability, durability and other features which adapt it to particular applications.

III. Liner 6

The liner 6 can comprise any suitable material such as paper stock 32 with an inner/front surface 32*a* and an outer/back surface 32*b*. A coating 34 of silicon is applied to the liner inner/front surface 32 to facilitate release of the labels 28. The liner 6 includes liner side margins 36 and liner end margins 38 which are spaced slightly outwardly from respective face stock side and end margins 10, 12 whereby a liner border 40 is provided and surrounds the face stock layer 4. The liner 6 is preferably sized (e.g. 8½"×11") to conform to the standard paper sizes used in existing printing and copying equipment. By providing a liner border 40 whereat the face stock layer margins 10,12 are held back slightly from the liner margins 36, 38, problems with adhesives contacting the paper trays and other parts of the printing and copying equipment are minimized. Potential problems associated with adhesive residue in such equipment can thus be reduced. The liner border 40 is exposed when the face stock layer selvage 13 is removed.

IV. First Modified Embodiment Label Sheet 102

Figure 6:
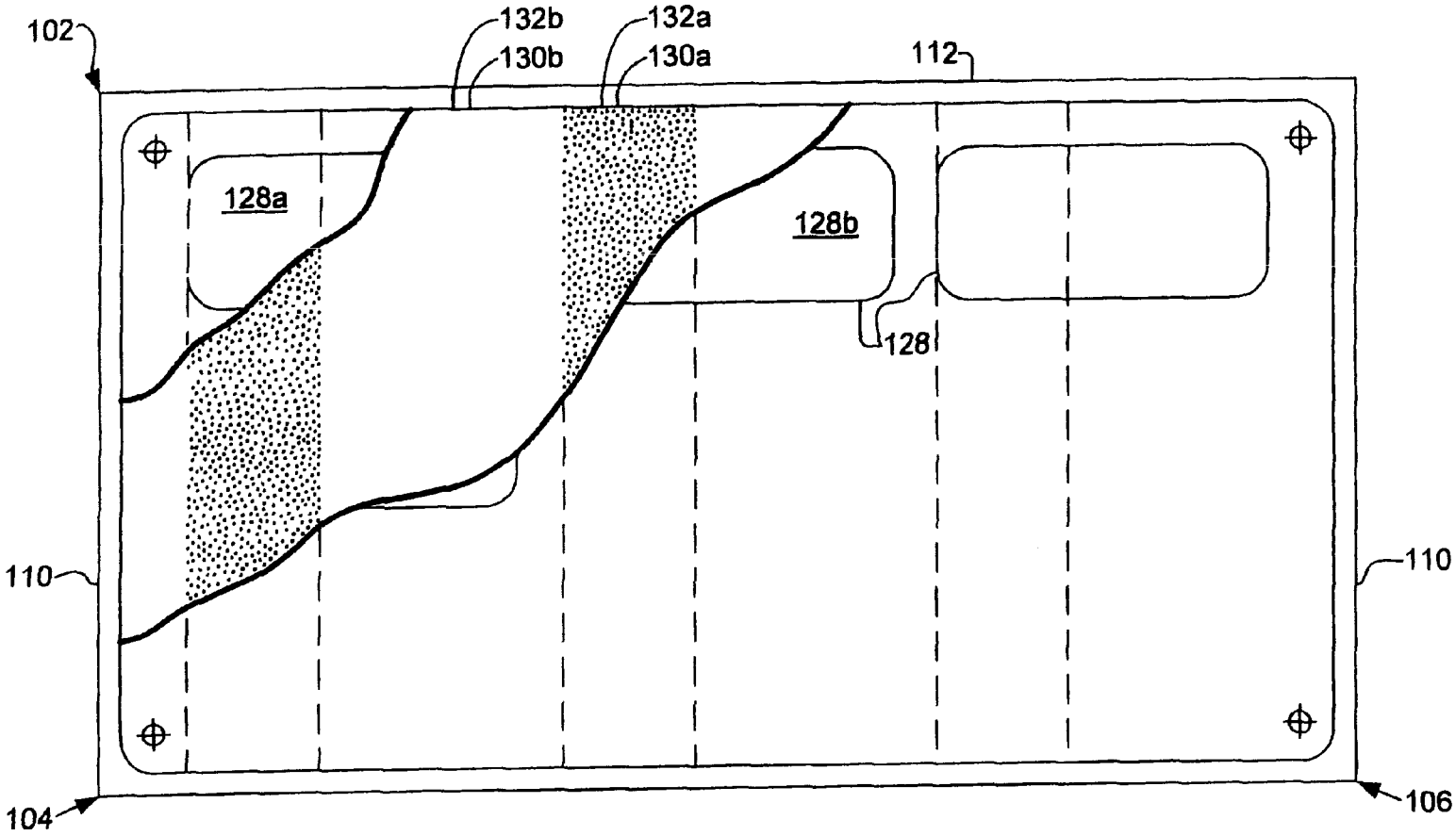
FIG. 6 is a plan view of a partially-secured label sheet comprising a modified embodiment of the present invention.

A label sheet 102 comprising a first modified embodiment of the present invention is shown in FIG. 6 and generally includes a modified face stock layer 104 mounted on a liner 106. The face stock layer 104 orients differently on the label sheet 102 from the previously described label sheet 2. Specifically, the label sheet 102 includes alternating strips 132 of active and inactive adhesive portions 130*a* and 130*b* respectively. The alternating active/inactive strips 132*a,b* extend between opposite end margins 112 whereby the longitudinal dimension of the label sheet 102 is formed across the lesser dimension of the finished label sheet 102. The face stock layer 104 also includes opposite side margins 110, the spacing of which is greater than the spacing of the end margins 112. The orientation of the adhesive strips 132 with respect to the finished label sheets 102 can be controlled by varying the width of the continuous stock material 3 from which the label sheets 2 and 102 are formed.

As with the label sheet 2 described above, the face stock layer 104 of the label sheet 102 is kiss-cut to provide multiple labels 128 with the desired configuration. Each label 128 includes an attachment end 128*a* and a free/unattached end 128*b*. The label ends 128*a,b* are formed by the active and inactive adhesive portions 130*a,b* respectively.

V. Manufacturing Method

Figure 3:
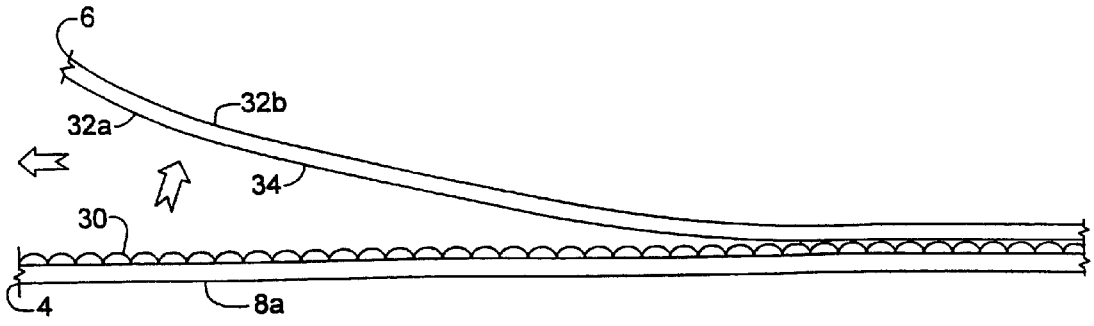
FIG. 3 is a cross-sectional view of a stock material being delaminated.
Figure 4:
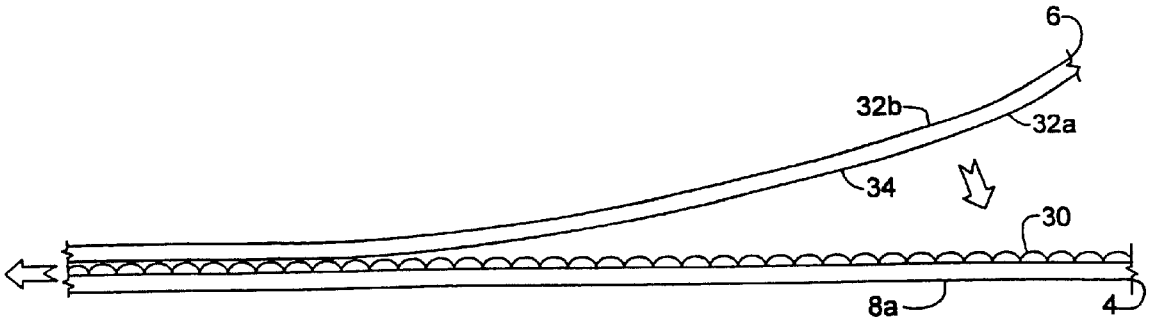
FIG. 4 is a cross-sectional view of the stock material being relaminated.
Figure 7:
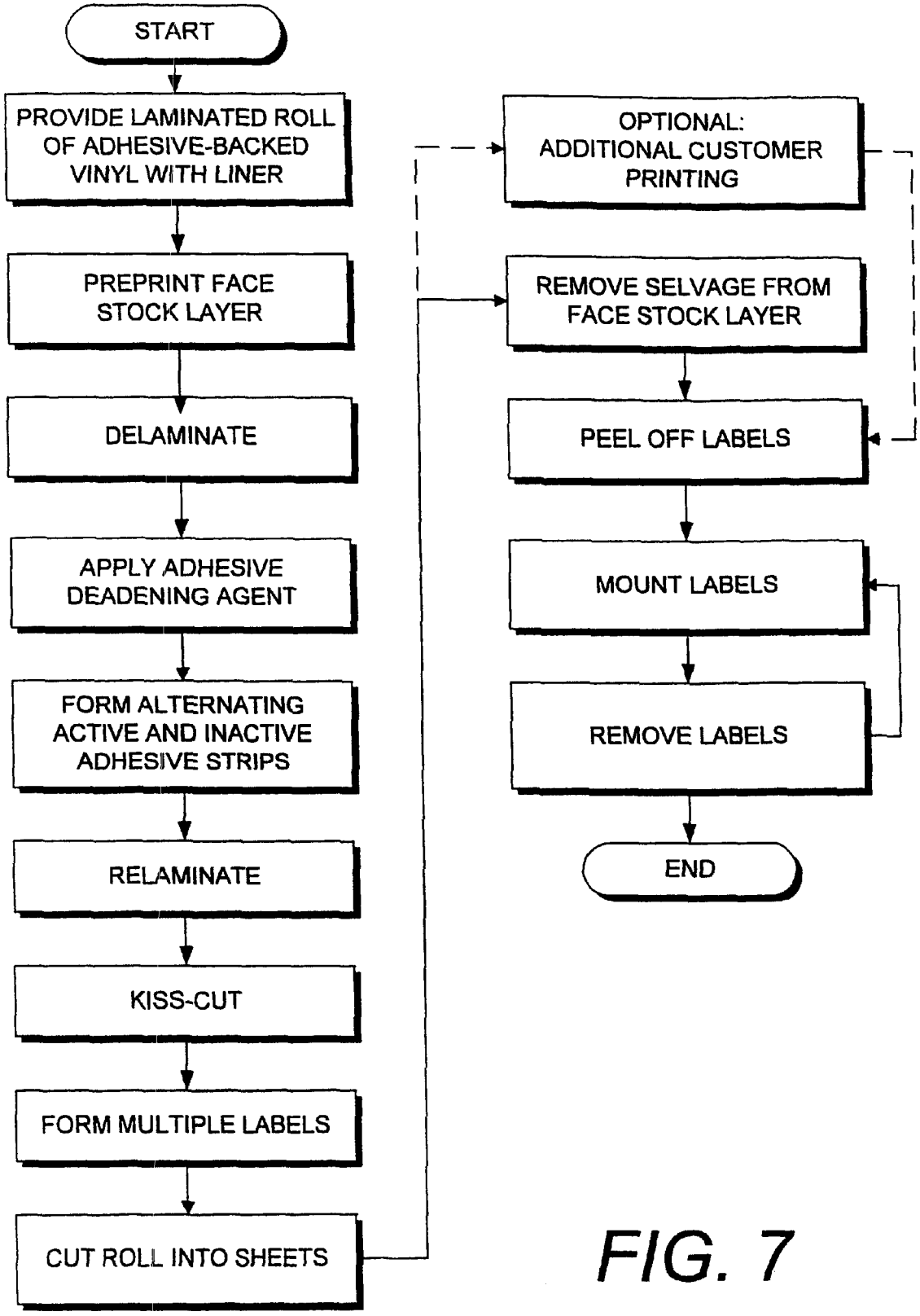
FIG. 7 is a flow chart showing the steps of a method of manufacturing the partially-secured labels according to the present invention.

A method of manufacturing the label sheets 2 and 102 can be practiced on existing printing equipment, such as flexographic presses, with little or no modification. The steps of the manufacturing method are generally shown in FIG. 7. A roll of laminated stock material 3 comprising the adhesive-backed face stock layer 4 or 104 and the liner 6 or 106 is provided. The preprinting 18 is applied to the face stock layer 4 or 104. The stock material 3 is then delaminated as shown in FIG. 3 by suitable equipment. The adhesive deadening agent is applied to the adhesive layer 30 or 130 to form the alternating adhesive strips 32 or 132 with active adhesive portions 30*a*, 130*a* and inactive adhesive portions 30*b*, 130*b* (FIG. 5). The material is then relaminated as shown in FIG. 4, whereby the face stock layer 4 or 104 is engaged and retained by the adhesive layer active portions

30*a*, or 130*a*. The face stock layers 4 or 104 are then kiss-cut on suitable equipment to provide the cut pattern 22 to define the labels 28 or 128.

The stock material 3 is then cut transversely to form multiple label sheets 2 or 102. The face stock layer selvage 13 is removed from the liner 6 or 106 whereby the label sheets 2 or 102 are in condition for delivery to customers. An optional customer printing step can be performed on the customer's printing or copying equipment to apply the customized printing 20. Alternatively, in a service bureau type of operation, all of the printing is done during the primary manufacturing process.

Figure 2:
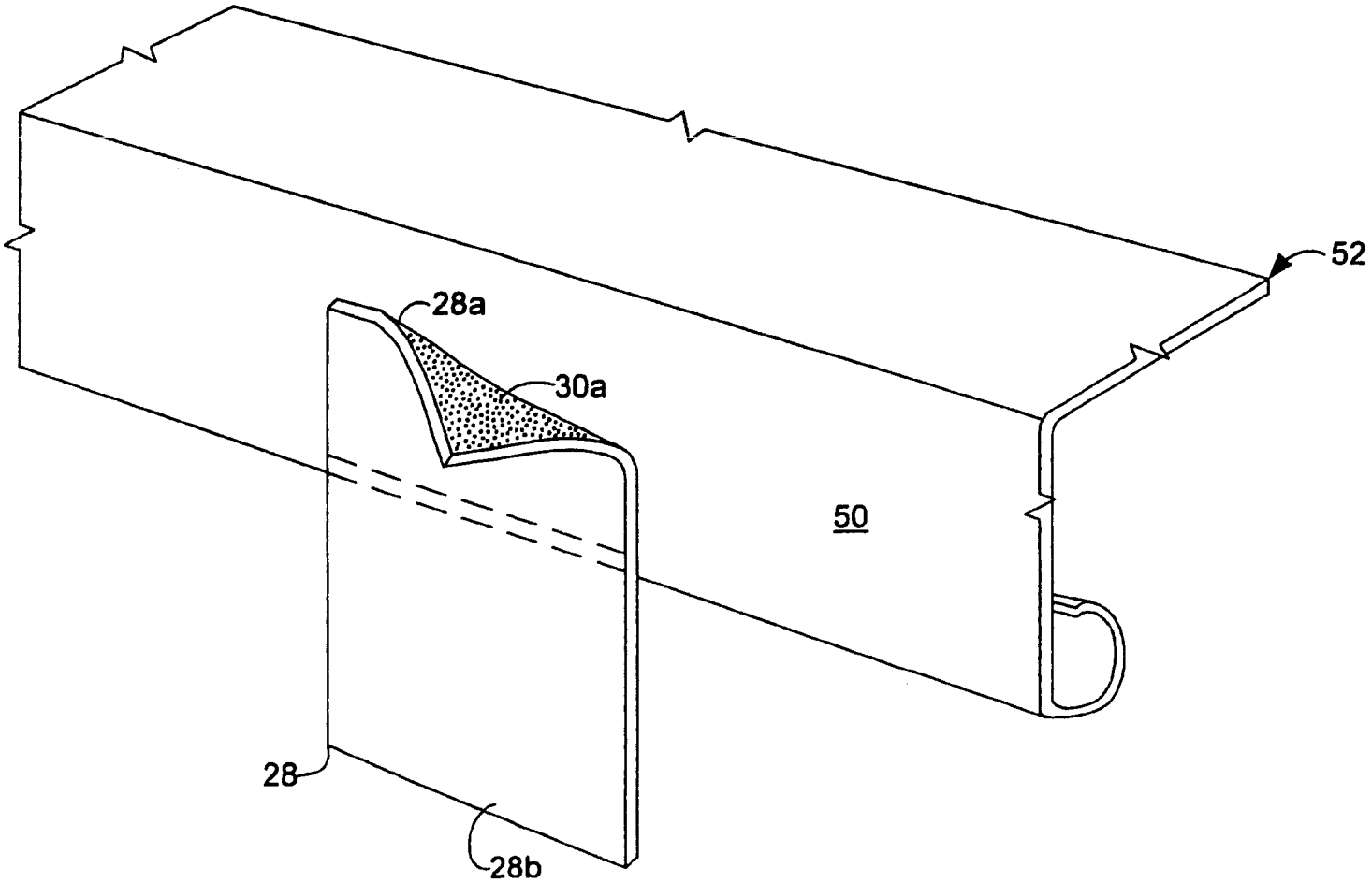
FIG. 2 is a perspective view of one of the partially-secured labels, shown attached to a shelf front edge.

The labels 28 or 128 are mounted by peeling them off of the liner 6 or 106 and pressing their attachment ends 28 or 128 onto a suitable mounting structure, such as the edge 50 of a shelf 52 (FIG. 2) in a retail store. By utilizing repositionable adhesive 30 or 130, the labels 28 or 128 can be removed and remounted.

Considerable savings in store personnel labor can be achieved by eliminating the step of removing a liner from a portion of the back of each label, as was required with previous label constructions. Moreover, since the labels 28 and 128 comprise only the face stock layers 4 and 104 respectively, and do not include any liner pieces, they are less susceptible to freezer curl caused by differential thermal expansion and contraction of different materials.

It is to be understood that while certain forms of the present invention have been illustrated and described herein, it is not to be limited to the specific forms or arrangement of parts described and shown.

What is claimed and desired to be secured by Letters Patent is as follows:

1. A label sheet comprising:

(a) a face stock layer having a printed outer surface and an inner surface and an upper edge and a lower edge; and (b) a liner adhesively attached to said inner surface of said face stock with a layer of adhesive; said layer of adhesive comprising a strip of an active adhesive adjacent said upper edge of said face stock layer and a strip of inactive adhesive adjacent said lower edge of said inner surface of said face stock layer; said inactive adhesive including a layer of adhesive deactivating material applied over said layer of adhesive.

2. A label sheet comprising:

(a) a face stock layer having a printed outer surface and an inner surface; said face stock layer having an upper edge and a lower edge; and (b) a layer of adhesive on said inner surface of said face stock layer; said layer of adhesive comprising a strip of an active adhesive at the upper edge of said inner surface of said face stock layer and a strip of inactive adhesive at the lower edge of said inner surface of said face stock layer; said inactive adhesive including a layer of adhesive deactivating material applied over said layer of adhesive.

3. A label sheet comprising:

(a) a face stock layer having a printed outer surface and an inner surface; said face stock layer having a upper edge and a lower edge;

(b) a liner adhesively attached to said inner surface of said face stock with a layer of adhesive; said layer of adhesive comprising a strip of an active adhesive at said upper edge of said inner surface of said face stock layer and a strip of inactive adhesive at said lower edge of said inner surface of said face stock layer; said inactive adhesive including a layer of adhesive deactivating material applied over said layer of adhesive; and (c) wherein said face stock layer is cut into one or more labels by a cut line extending into the face stock layer and terminating in the proximity of the adhesive layer.

4. A repositionable shelf label which consists essentially of:

(a) a face stock layer having a printed outer surface and an inner surface; said face stock layer having an upper edge and a lower edge; and (b) a layer of adhesive on said inner surface of said face stock layer; said layer of adhesive comprising a strip of an active adhesive at said upper edge of said inner surface of said face stock layer and a strip of inactive adhesive at said lower edge of said inner surface of said face stock layer; said inactive adhesive including a layer of adhesive deactivating material applied over said layer of adhesive; and (c) wherein said face stock layer is cut into one or more labels by a cut line extending into the face stock layer and terminating in the proximity of the adhesive layer.

5. The label sheet of claim 1 wherein the adhesive layer is comprises an acrylic adhesive.

6. The label sheet of claim 1 where the active and inactive adhesive label portions are generally rectangular.

7. The label sheet of claim 1 where the face stock layer outer surface includes preprinted subject matter.

8. The label sheet of claim 1, which includes:

a) a longitudinal axis;

b) a transverse axis;

c) a plurality of the labels arranged in rows and columns on the label sheet; and d) a plurality of longitudinally-extending strips of the adhesive deactivating material, each strip corresponding to a label row.

9. The label sheet of claim 1, which includes:

a) a longitudinal axis;

b) a transverse axis;

c) a plurality of the labels arranged in rows and columns on the label sheet; and d) a plurality of transversely-extending strips of the adhesive deactivating material, each strip corresponding to a label row.

* * * * *